US009081330B2

(12) United States Patent
Okuno

(10) Patent No.: US 9,081,330 B2
(45) Date of Patent: Jul. 14, 2015

(54) DEVELOPING DEVICE AND IMAGE FORMING APPARATUS

(71) Applicant: FUJI XEROX CO., LTD., Minato-ku, Tokyo (JP)

(72) Inventor: Taichiro Okuno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 7 days.

(21) Appl. No.: 14/011,932

(22) Filed: Aug. 28, 2013

(65) Prior Publication Data

US 2014/0212179 A1 Jul. 31, 2014

(30) Foreign Application Priority Data

Jan. 28, 2013 (JP) ..... 2013-013023

(51) Int. Cl.
*G03G 15/08* (2006.01)

(52) U.S. Cl.
CPC ..... *G03G 15/0893* (2013.01); *G03G 2215/083* (2013.01); *G03G 2215/0833* (2013.01)

(58) Field of Classification Search
CPC ..... G03G 15/0891; G03G 2215/0833; G03G 2215/083
USPC ..... 399/254
See application file for complete search history.

(56) References Cited

U.S. PATENT DOCUMENTS

| | | | | |
|---|---|---|---|---|
| 6,763,214 | B2 * | 7/2004 | Sugihara | 399/254 |
| 8,611,770 | B2 * | 12/2013 | Mizutani et al. | 399/35 |
| 2012/0251185 | A1 * | 10/2012 | Matsumoto | 399/258 |

FOREIGN PATENT DOCUMENTS

| | | | |
|---|---|---|---|
| JP | 05134544 | A * | 5/1993 |
| JP | 11-44986 | A | 2/1999 |
| JP | 2006-171105 | A | 6/2006 |
| JP | 2010038939 | A * | 2/2010 |
| JP | 2010039169 | A * | 2/2010 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

A developing device includes a developing-device body that includes a supply opening to which toner is supplied and a transporting member that is provided in the developing-device body and that transports the toner and a carrier while stirring the toner and the carrier. The transporting member includes a rotating shaft, a first transporting section, and a second transporting section. The first transporting section and the second transporting section are spirally formed around the rotating shaft. The number of spirals of the first transporting section is less than the number of spirals of the second transporting section. At least a portion of the first transporting section opposes the supply opening of the developing-device body. The second transporting section is formed at a portion other than the first transporting section that opposes the supply opening.

8 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2013-013023 filed Jan. 28, 2013.

BACKGROUND

Technical Field

The present invention relates to a developing device and an image forming apparatus.

SUMMARY

According to an aspect of the invention, there is provided a developing device including a developing-device body that includes a supply opening to which toner is supplied and a transporting member that is provided in the developing-device body and that transports the toner and a carrier while stirring the toner and the carrier. The transporting member includes a rotating shaft, a first transporting section, and a second transporting section. The first transporting section and the second transporting section are spirally formed around the rotating shaft. The number of spirals of the first transporting section is less than the number of spirals of the second transporting section. At least a portion of the first transporting section opposes the supply opening of the developing-device body. The second transporting section is formed at a portion other than the first transporting section that opposes the supply opening.

BRIEF DESCRIPTION OF THE DRAWINGS

An exemplary embodiment of the present invention will be described in detail based on the following figures, wherein.

DETAILED DESCRIPTION

An exemplary embodiment of the present invention is described with reference to the drawings.

Figure 1:
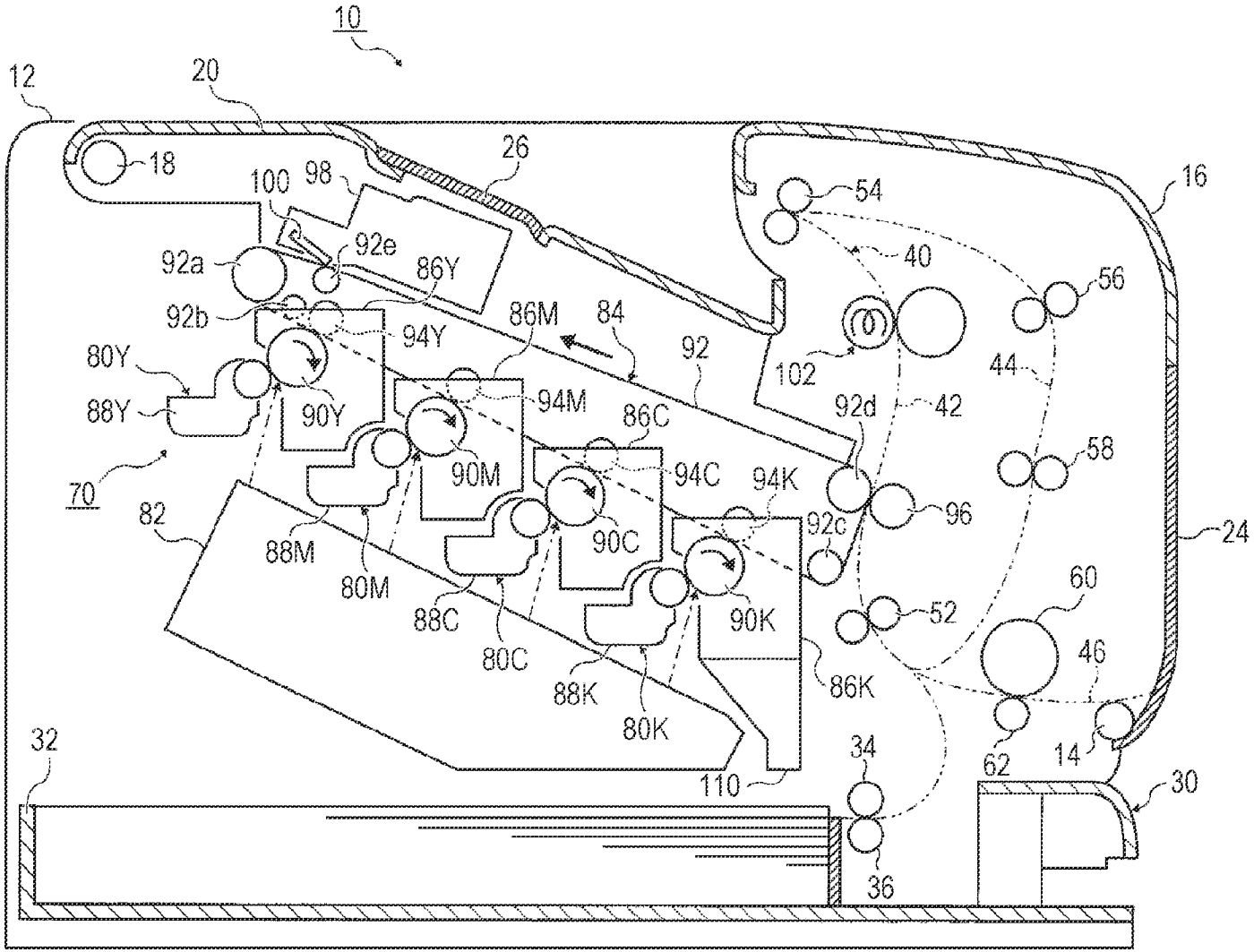
FIG. 1 is a sectional view of an image forming apparatus according to an exemplary embodiment of the present invention.

FIG. 1 is a sectional view of an image forming apparatus 10 according to the exemplary embodiment of the present invention.

The image forming apparatus 10 includes an image-forming-apparatus body 12. A front-side opening-closing portion 16 that is opened and closed at a front side (right side in FIG. 1) via a hinge 14 is mounted to the image-forming-apparatus body 12. In addition, an upper-side opening-closing portion 20 that is opened and closed at an upper side via a hinge 18 is mounted to the image-forming-apparatus body 12.

A supply opening-closing portion 24 that is opened and closed at the front side is mounted to the front-side opening-closing portion 16. The supply opening-closing portion 24 is ordinarily closed with respect to the front-side opening-closing portion 16. When the supply opening-closing portion 24 is opened, a recording medium is supplied to an auxiliary transport path 46 (described later).

A top surface of the upper-side opening-closing portion 20 is used as a discharge portion to which a recording medium on which an image is formed is discharged. An auxiliary opening-closing portion 26 that is capable of being opened and closed with respect to the upper-side opening-closing portion 20 is mounted to the upper-side opening-closing portion 20. The auxiliary opening-closing portion 26 is capable of being opened and closed independently of the upper-side opening-closing portion 20. With the upper-side opening-closing portion 20 being in a closed state with respect to the image-forming-apparatus body 12, the auxiliary opening-closing portion 26 is capable of being in an open state with respect to the upper-side opening-closing portion 26.

The upper-side opening-closing portion 20 is opened when mounting or removing photoconductor units 86Y, 86M, 86C, 86K, and a developer collecting container 110 in the image-forming-apparatus body 12.

By opening the front-side opening-closing portion 16 before opening the upper-side opening-closing portion 20, for example, an intermediate transfer belt 92 (described later) mounted to the upper-side opening-closing portion 20 is prevented from interfering with the front-side opening-closing portion 16.

In closing the front-side opening-closing portion 16, the upper-side opening-closing portion 20 is closed prior to closing the front-side opening-closing portion 16.

A recording medium supplying device 30 that supplies recording media to an image forming section 70 (described later) is mounted at a lower portion of the interior of the image-forming-apparatus body 12. The recording medium supplying device 30 is capable of being drawn out to the front side of the image-forming-apparatus body 12 (right side in FIG. 1), and is replenished with recording media while it is drawn out from the image-forming-apparatus body 12.

The recording medium supplying device 30 includes, for example, a recording-medium storage container 32 that stores stacked recording media such as ordinary paper. The recording medium supplying device 30 includes a transport roller 34 and a retard roller 36. The transport roller 34 separates a topmost recording medium stored in the recording-medium storage container 32, and transports the separated recording medium towards the image forming section 70. The retard roller 36 loosens recording media and prevents multiple recording media that are placed upon each other from being transported to the image forming section 70.

A transport path 40 used for transporting recording media is formed in the image-forming-apparatus body 12. The transport path 40 includes a main transport path 42, an reverse transport path 44, and an auxiliary transport path 46.

The main transport path 42 is used to transport recording media supplied from the recording medium supplying device 30 to the image forming section 70, and to discharge the recording media on which images are formed to the outside of the image-forming-apparatus body 12. The transport roller 34 and the retard roller 36, registration rollers 52, a second transfer roller 96 (described later), a fixing device 102 (described later), and discharge rollers 54 are disposed along the main transport path 42 in that order from an upstream side in the direction in which recording media are transported.

The registration rollers 52 temporarily stop a leading end of a recording medium transported from the recording medium supplying device 30, and sends the recording medium to the second transfer roller 96 so as to match the timing in which an image is formed.

The discharge rollers 54 discharge a recording medium to which toners of corresponding colors are fixed by the fixing device 102 (described later) to the outside of the image-forming-apparatus body 12.

The reverse transport path 44 is used to re-supply a recording medium on whose one surface a developer image is formed towards the image forming section 70 while reversing the recording medium. For example, two reverse transport rollers 56 and two reverse transport rollers 58 are disposed along the reverse transport path 44.

The recording medium is transported from the main transport path 42 to the discharge rollers 54. With a trailing end portion of a recording medium being nipped by the discharge rollers 54, the discharge rollers 54 are reversely rotated, to supply the recording medium to the reverse transport path 44. The recording medium supplied to the reverse transport path 44 is transported to a location that is upstream of the registration rollers 52 by the reverse transport rollers 56 and the reverse transport rollers 58.

The auxiliary transport path 46 is a transport path used to supply to the image forming section 70 special recording media having, for example, sizes and paper qualities that differ from those of the recording media that are stored in the recording medium supplying device 30. With the supply opening-closing portion 24 being in an open state, a recording medium is supplied to the auxiliary transport path 46 from the front side of the image-forming-apparatus body 12. A transport roller 60 and a retard roller 62 are provided along the auxiliary transport path 46. The transport roller 60 transports a recording medium supplied to the auxiliary transport path 46 towards the image forming section 70. The retard roller 62 loosens recording media supplied to the auxiliary transport path 46 and prevents multiple recording media that are placed upon each other from being transported to the image forming section 70.

The image forming section 70 that forms an image on a recording medium is provided in the image-forming-apparatus body 12. The image forming section 70 includes, for example, four developer image forming sections (that is, developer image forming sections 80Y, 80M, 80C, and 80K), an optical forming device 82, and a transfer device 84.

The developer image forming sections 80Y, 80M, 80C, and 80K form developer images using a yellow (Y) developer, a magenta (M) developer, a cyan (C) developer, and a black (K) developer, respectively.

The developer image forming sections may be generically called developer image forming sections 80 without the letters Y, M, C, and K. This also similarly applies to other structural components (such as the photoconductor units 86 and developing devices 88) corresponding to Y, M, C, and K.

The developer image forming section 80Y includes the photoconductor unit 86Y and the developing device 88Y. The developer image forming section 80M includes the photoconductor unit 86M and the developing device 88M. The developer image forming section 80C includes the photoconductor unit 86C and the developing device 88C. The developer image forming section 80K includes the photoconductor unit 86K and the developing device 88K.

The photoconductor units 86Y, 86M, 86C, and 86K are disposed side by side in that order from the back side of the image-forming-apparatus body 12 (left side in FIG. 1).

The photoconductor units 86Y, 86M, 86C, and 86K are used as image forming structural members, and include photoconductor drums 90Y, 90M, 90C, and 90K, respectively. The photoconductor drums 90 are used as image carrying members.

Using the Y developer stored in the developing device 88Y, the M developer stored in the developing device 88M, the C developer stored in the developing device 88C, and the K developer stored in the developing device 88K, latent images formed on the corresponding photoconductor drums 90Y, 90M, 90C, and 90K are developed.

The optical forming device 82 is used as a latent image forming device, and forms latent images on the surfaces of the photoconductor drums 90Y, 90M, 90C, and 90K by irradiating the photoconductor drums (image carrying members) 90Y, 90M, 90C, and 90K with light.

The transfer device 84 includes the intermediate transfer belt 92, serving as a transfer member, first transfer rollers 94Y, 94M, 94C, and 94K, used as first transfer devices, the second transfer roller 96, used as a second transfer device, and a cleaning device 98.

The intermediate transfer belt 92 is an endless belt, and is supported by, for example, five support rollers (that is, support rollers 92*a*, 92*b*, 92*c*, 92*d*, and 92*e*) so that the intermediate transfer belt 92 is capable of rotating in the direction of the arrow in FIG. 1. At least one of the support rollers 92*a*, 92*b*, 92*c*, 92*d*, and 92*e* is connected to a motor (not shown). When this support roller receives a driving force from the motor, it rotates, so that the intermediate transfer belt 92 is rotationally driven.

The first transfer rollers 94Y, 94M, 94C, and 94K transfer to the intermediate transfer belt 92 developer images formed on the surfaces of the corresponding photoconductor drums 90Y, 90M, 90C, and 90K by the corresponding developing devices 88Y, 88M, 88C, and 88K.

The second transfer roller 96 transfers to a recording medium the Y, M, C, and K developer images transferred to the intermediate transfer belt 92.

The cleaning device 98 includes a scraping-off member 100 that scrapes off toners of developers of the corresponding colors remaining on the surface of the intermediate transfer belt 92 after transferring the developer images of the corresponding colors to the recording medium by the second transfer roller 96. The toners that are scraped off by the scraping-off member 100 are collected in the body of the cleaning device 98.

The cleaning device 98 is mountable to and removable from the interior of the image-forming-apparatus body 12 via an opening that is provided when the auxiliary opening-closing portion 26 is opened.

Of the components that make up the transfer device 84, the intermediate transfer belt 92, the support rollers 92*a*, 92*b*, 92*c*, 92*d*, and 92*e*, the first transfer rollers 94, and the cleaning device 98 are mounted to the upper-side opening-closing portion 20. The second transfer roller 96 of the transfer device 84 is mounted to the image-forming-apparatus body 12.

The fixing device 102 that fixes to a recording medium the developer images transferred to the recording medium by the second transfer roller 96 is provided in the image-forming-apparatus body 12.

The developer collecting container 110 is provided in the image-forming-apparatus body 12. The developer collecting container 110 is used as a discharged developer collecting container that collects the developer discharged from at least one of the developer image forming sections 80Y, 80M, 80C, and 80K.

In the exemplary embodiment, the developer collecting container 110 collects the developers discharged from all four of the developer image forming sections 80Y, 80M, 80C, and 80K. More specifically, in the exemplary embodiment, the developer collecting container 110 collects the developers discharged from the developing device 88Y of the developer image forming section 80Y, the developing device 88M of the developer image forming section 80M, the developing device 88C of the developer image forming section 80C, and the developing device 88K of the developer image forming section 80Y.

The developer collecting container 110 is not limited to the structure according to the exemplary embodiment that collects the developers discharged from the developing devices 88 of the developer image forming sections 80. In place of this structure or in combination with this structure, a structure that collects developers discharged from the developer image forming sections 80 and developers discharged from components other than the developing devices 88 (such as developers removed from the surfaces of the photoconductor drums 90) may be used.

In the exemplary embodiment, the developer collecting container 110 is integrated to the photoconductor unit 86K, and is mounted to and removed from the interior of the image-forming-apparatus body 12 together with the photoconductor unit 86K.

The developer collecting container 110 is not limited to the structure in which it is integrated to the photoconductor unit 86K. Instead, it may be integrated to any of the other photoconductor units 86Y, 86M, and 86C, and mounted to and removed from the interior of the image-forming-apparatus body 12 together with the photoconductor unit to which the developer collecting container 110 is integrated.

Alternatively, the developer collecting container 110 may be provided independently of the photoconductor unit 86.

Next, the developing devices 88 are described in detail. Since the developing devices 88Y, 88M, 88C, and 88K, which, though, correspond to different colors, have the same structure, the letters Y, M, C, and K will not appear beside the reference numbers of the developing devices.

Figure 2:
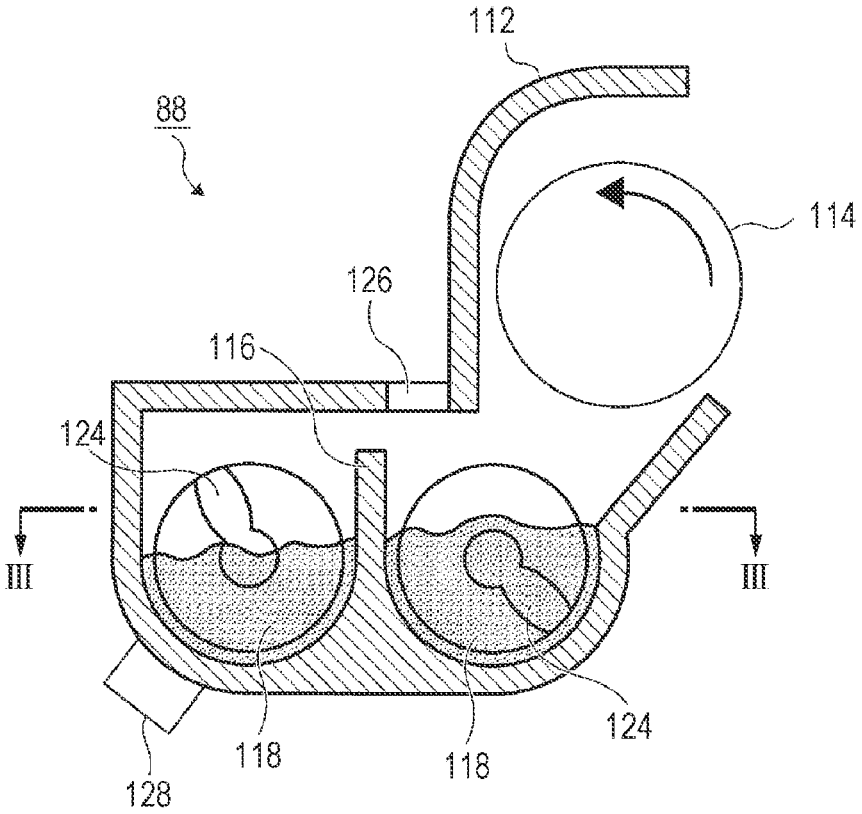
FIG. 2 is a sectional view of a developing device used in the exemplary embodiment of the present invention.
Figure 3:
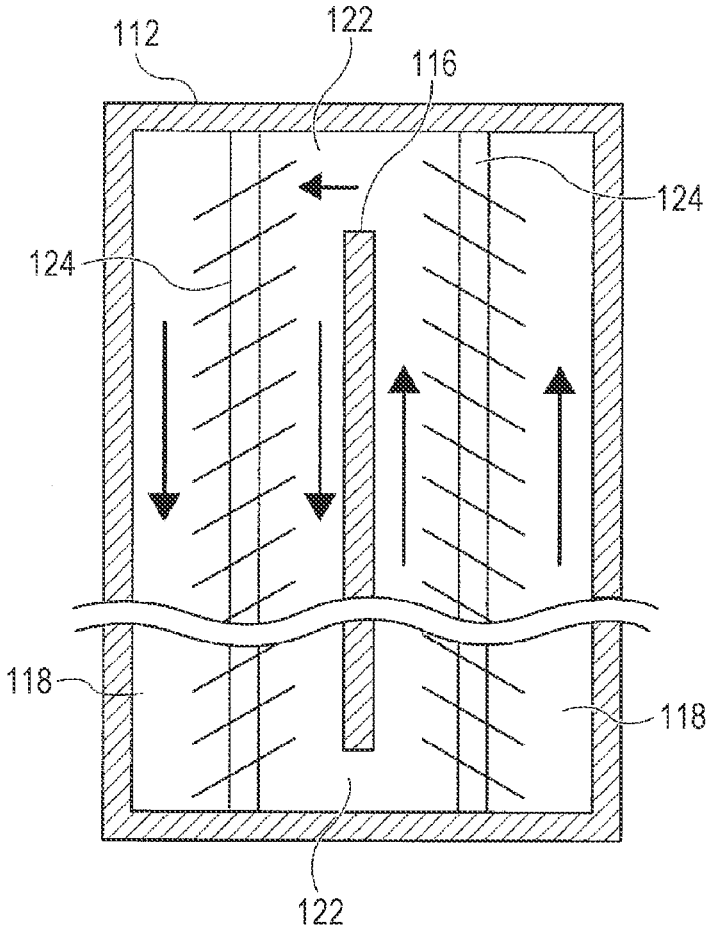
FIG. 3 is a sectional view of the developing device used in the exemplary embodiment of the present invention taken along line III-III in FIG. 2.
Figure 4:
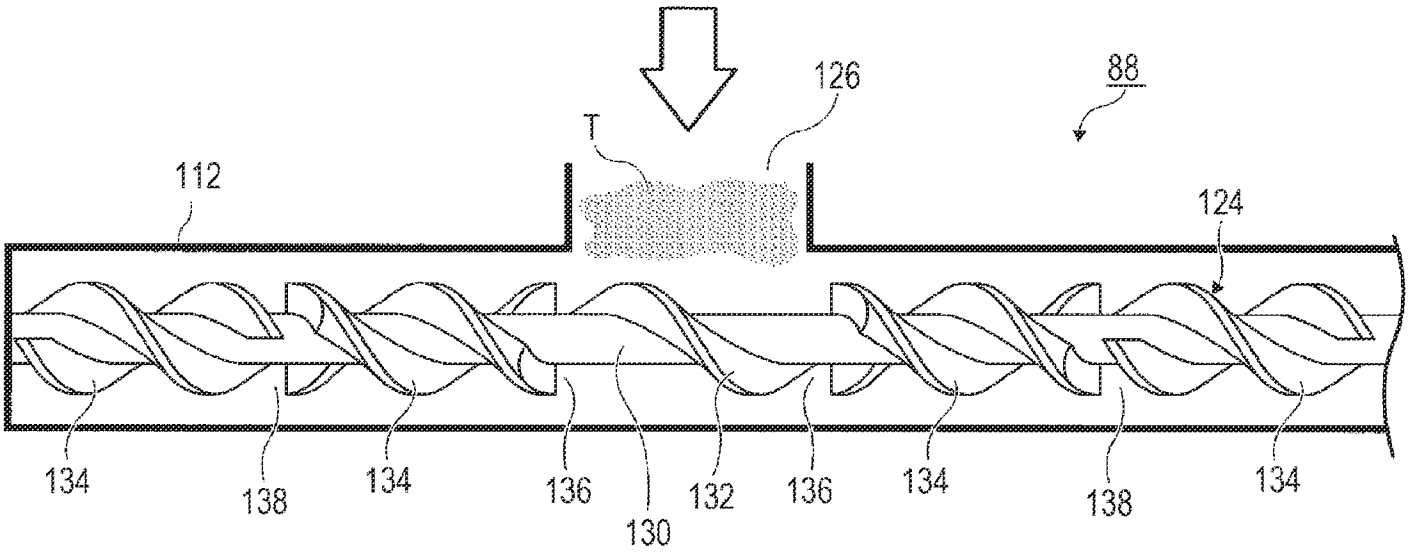
FIG. 4 is a side view primarily illustrating a transporting member of the developing device used in the exemplary embodiment of the present invention.

FIG. 2 is a sectional view of one of the developing devices 88. FIG. 3 is a sectional view taken along line III-III in FIG. 2. FIG. 4 is a side view primarily illustrating one of the transporting members.

The developing devices 88 are two-component developing devices that develop latent images using two-component developers containing toners and carriers. Each developing device 88 includes a developing-device body 112 and stores developer in the interior of the associated developing-device body 112.

A developing roller 114, used as a developer carrying member, is mounted in the interior of each developing-device body 112. Each developing roller 114 rotates in the direction of the arrow shown in FIG. 2 to supply developer carried by the surface of the corresponding developing roller to the associated photoconductor drum 90 (see FIG. 1), so that the latent image on the surface of the associated photoconductor drum 90 is developed.

The interior of each developing-device body 112 is, for example, divided into two spaces by one partition member 116. The divided spaces correspond to developer transport paths 118 and 118. The developer transport paths 118 and 118 are used as paths for stirring and transporting developer in its associated developing-device body 112. Connecting openings 122 and 122 are formed in corresponding sides of each partition member 116.

Transporting members 124 and 124 that stir and transport developer are provided in the associated developer transport paths 118 and 118. By rotating the transporting members 124 and 124, the developer circulates in the developer transport paths 118 and 118 via the connecting openings 122 and 122 while being stirred.

A supply opening 126 for supplying toner is formed in each developing-device body 112. Each supply opening 126 is formed, for example, vertically in the associated developing-device body 112. Each supply opening 126 is connected to a toner storage section (toner cartridge) (not shown) via a supply path.

In what is called a trickle development system in which old carriers are discharged, carriers are also supplied into each developing-device body 112.

A toner density sensor 128 for detecting toner density is provided at each developing-device body 112. Each toner density sensor 128 detects, for example, magnetic permeability of the developer.

As shown in FIG. 4, each transporting member 124 includes a rotating shaft 130, a first blade portion 132, and a second blade portion 134. Each rotating shaft 130 extends, for example, horizontally. The first blade portion 132 and the second blade portion 134 are spirally formed around the rotating shaft 130. The first blade portion 132 is an exemplary first transporting section and the second blade portion 134 is an exemplary second transporting section.

The first blade portion 132 includes, for example, one spiral, and opposes the supply opening 126. The term "opposes" means that the first blade portion 132 is within a range of the area of the supply opening 126, the range being provided by vertically projecting the supply opening 126. Although, in the exemplary embodiment, a portion of the first blade portion 132 opposes the supply opening 126, the first blade portion 132 may oppose the supply opening 126 in its entirety.

The second blade portion 134 includes, for example, two spirals, and is formed in a portion other than the first blade portion 132 opposing the supply opening 126. The second blade portion 134 includes spirals whose positions are shifted from each other by, for example, 180 degrees in a peripheral direction.

Although, in the exemplary embodiment, the first blade portion 132 includes one spiral and the second blade portion 134 includes two spirals, the structures are not limited thereto. For example, the number of spirals of the first blade portion 132 may be less than the number of spirals of the second blade portion 134 (that is, for example, the number of spirals of the first blade portion 132 may be two and the number of spirals of the second blade portion 134 may be three).

A first gap 136 is formed between the first blade portion 132 and one of the second blade portions 134 that is adjacent thereto. Another first gap 136 is formed between the first blade portion 132 and the other second blade portion 134 that is adjacent thereto. A second gap 138 is formed between the second blade portions 134 and 134 that are adjacent to each other. The positions of the second blade portions 134 and 134 that are adjacent to each other are shifted from each other by, for example, 90 degrees in the peripheral direction. The position of the first blade portion 132 is shifted by approximately 90 degrees from that of one spiral of each of the second blade portions 134 and 134 that are adjacent to the first blade portion 132.

Next, the operation of each developing device 88 is described.

When any toner density sensor 128 detects that the toner density is low, toner is supplied into the associated supply opening 126 from a toner storage section (not shown). The toner supplied from the supply opening 126 is stirred and transported by the associated first blade portion 132 that is rotating along with the associated rotating shaft 130. Here, since the first blade portion 132 includes one spiral, the reciprocating motion of developer stirred by the first blade portion 132 towards the supply opening 126 (that is, an up-down motion in FIG. 4) is larger than that when two spirals are used. Therefore, toner T near the supply opening 126 is greatly vibrated in the up-down direction by the first blade portion 132. In the exemplary embodiment, a first gap 136 is formed between the first blade portion 132 and one of the adjacent second blade portions 134, and another first gap 136 is formed between the first blade portion 132 and the other adjacent second blade portion 134. Even if the developer temporarily stagnates in any of the first gaps 136, and clogging occurs near the supply opening 126, the developer is loosened by the operation of the first blade portion 132 including a smaller number of spirals.

The toner T that has been loosened by the first blade portion 132 is, along with carriers, stirred by the first blade portion 132, and is transported towards the second blade portions 134 that are adjacent to the first blade portion 132.

The developer that is transported to the second blade portions 134 that are adjacent to the first blade portion 132 is further transported to adjacent second blade portions 134. Since the number of spirals of the second blade portion 134 is greater than the number of spirals of the first blade portion 132, the second blade portion 134 has better stirring capability and transporting capability than the first blade portion 132.

Second gaps 138 are formed between the second blade portions 134 and 134 that are adjacent to each other, and the positions of the second blade portions 134 and 134 are shifted from each other. Therefore, the developer transported to the second gaps 132 temporarily stagnates, and is considerably stirred and mixed in the stagnated state.

The developer that is stirred and transported in this way circulates in the developer transport paths 118 and is supplied to the developing roller 114, to obtain a target image density.

In the exemplary embodiment, each first blade portion 132 is provided only at a portion that opposes the associated supply opening 126. However, it is possible to provide each first blade portion 132 at other portions. For example, each first blade portion 132 may be provided at a portion that opposes the associated toner density sensor 128.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing-device body that includes a supply opening to which toner is supplied; and a transporting member that is provided in the developing-device body, the transporting member transporting the toner and a carrier while stirring the toner and the carrier, wherein the transporting member includes a rotating shaft, a first transporting section, and a second transporting section, the first transporting section and the second transporting section being spirally formed around the rotating shaft, wherein the number of spirals of the first transporting section is less than the number of spirals of the second transporting section, wherein at least a portion of the first transporting section opposes the supply opening of the developing-device body, and wherein the second transporting section is formed at a portion other than the first transporting section that opposes the supply opening, wherein a plurality of the second transporting sections are provided adjacent to each other, wherein a gap is provided between the second transporting sections that are adjacent to each other, and wherein positions of the second transporting sections that are adjacent to each other are shifted from each other in a peripheral direction thereof.

2. The developing device according to claim 1, wherein the first transporting section includes one spiral and the second transporting section includes two spirals.

3. The developing device according to claim 1, wherein at least a portion of the first transporting section is formed only at a portion opposing the supply opening of the developing-device body.

4. The developing device according to claim 1, wherein the second transporting section is adjacent to the first transporting section, and wherein a gap is provided between the first transporting section and the second transporting section that is adjacent to the first transporting section.

5. The developing device according to claim 1, wherein the positions of the second transporting sections that are adjacent to each other are shifted from each other by 90 degrees in the peripheral direction thereof.

6. An image forming apparatus comprising:

an image carrying member on which a latent image is formed; and the developing device according to claim 1 that develops the latent image on the image carrying member, wherein the developing device includes the developing-device body that includes the supply opening to which the toner is supplied, and the transporting member that is provided in the developing-device body, the transporting member stirring and transporting the toner and the carrier, wherein the transporting member includes the rotating shaft, the first transporting section, and the second transporting section, the first transporting section and the second transporting section being spirally formed around the rotating shaft, wherein the number of spirals of the first transporting section is less than the number of spirals of the second transporting section, wherein at least a portion of the first transporting section opposes the supply opening of the developing-device body, and wherein the second transporting section is formed at a portion other than the first transporting section that opposes the supply opening, wherein a plurality of the second transporting sections are provided adjacent to each other, wherein a gap is provided between the second transporting sections that are adjacent to each other, and wherein positions of the second transporting sections that are adjacent to each other are shifted from each other in a peripheral direction thereof.

7. A developing device comprising:

a developing-device body that includes a supply opening to which toner is supplied; and a transporting member that is provided in the developing-device body, the transporting member transporting the toner and a carrier while stirring the toner and the carrier, wherein the transporting member includes a rotating shaft, a first blade portion, and a plurality of second blade portions, wherein the first blade portion and the plurality of second blade portions are positioned at different locations in an axial direction of the rotating shaft, wherein the first blade portion and the plurality of second blade portions are not formed continuously, wherein the first blade portion includes one first spiral and opposes the supply opening, and wherein each second blade portion includes a plurality of second spirals that are parallel to each other.

8. The developing device according to claim 7, wherein a position at an end portion of the first spiral and a position at an end portion of one of the second spirals differ by approximately 90 degrees.

* * * * *